US005125351A

United States Patent [19]

Prais et al.

[11] Patent Number: 5,125,351

[45] Date of Patent: Jun. 30, 1992

[54] THREAD TRIMMER SYSTEM FOR IN-LINE CHAIN STITCH CYLINDER BED SEWING MACHINE

[75] Inventors: Eugene R. Prais, West Milford; Glenn P. Trimboli, Union, both of N.J.

[73] Assignee: Kansai Special U.S.A. Corp., Carlstadt, N.J.

[21] Appl. No.: 617,531

[22] Filed: Nov. 23, 1990

[51] Int. Cl.[5] ..... D05B 65/02; D05B 57/02

[52] U.S. Cl. ..... 112/292; 112/63; 112/165; 112/288; 112/262.1

[58] Field of Search ..... 112/292, 291, 288, 293, 112/295, 298, 165, 199, 294, 63, 262.1, 262.2

[56] References Cited

U.S. PATENT DOCUMENTS

| | | | |
|---|---|---|---|
| 4,098,209 | 7/1978 | Schopf | 112/298 |
| 4,365,568 | 12/1982 | Ross | 112/291 |
| 4,726,305 | 2/1988 | Seto | 112/298 |
| 4,834,010 | 5/1989 | Choi et al. | 112/292 |
| 4,879,960 | 11/1989 | Prais | 112/294 X |
| 4,886,005 | 12/1989 | Burton, Jr. | 112/292 |

FOREIGN PATENT DOCUMENTS

| | | | |
|---|---|---|---|
| 0272391 | 11/1988 | Japan | 112/292 |
| 0282193 | 9/1970 | U.S.S.R. | 112/292 |
| 0400639 | 5/1974 | U.S.S.R. | 112/296 |

*Primary Examiner*—Peter Nerbun

*Attorney, Agent, or Firm*—Killworth, Gottman, Hagan & Schaeff

[57] ABSTRACT

Apparatus and method for severing the needle and looper threads of a chain stitch formed by a cylinder bed sewing machine having an in-line looper system is disclosed. The cylinder bed sewing machine has a needle plate and a needle carrying the needle thread through the material and the needle plate to form a needle loop of needle thread therebelow that has a needle side running to the needle. The apparatus comprises a device operating as a dual needle plate holder and knife slide base, a stationary knife positioned below the needle plate, a spring positioned below said stationary knife, a movable knife positioned on the knife slide base and slidably mounted between the stationary knife and the spring for yieldingly urging the movable knife thereagainst. The movable knife has one penetrating end with a pair of axially offset barbs, a lagging barb and a leading barb closer to the penetrating end of the movable knife than the lagging barb. Finally, the apparatus includes actuating means, connected to the other end of the movable knife, for extending the penetrating end through the needle loop so that the leading barb hooks the needle side of the needle loop and the lagging barb hooks the looper thread and retracts the penetrating end. These elements cooperate to hook and sever the needle side of the needle loop and the looper thread below the needle plate of the cylinder bed sewing machine and prepare the looper thread for the next stitch.

7 Claims, 11 Drawing Sheets

THREAD TRIMMER SYSTEM FOR IN-LINE CHAIN STITCH CYLINDER BED SEWING MACHINE

BACKGROUND OF THE INVENTION

The present invention relates to a chain stitch sewing machine and, more particularly, to an in-line chain stitch sewing machine having a thread trimmer system which operates automatically below the needle plate of a cylinder bed sewing machine.

The sewing machine of the present invention is used exclusively to form a chain stitch, which is well known in the art as a type 401 stitch, and is to be distinguished from machines forming other types of stitches such as, for example, a lock stitch formed by sewing machines disclosed in U.S. Pat. Nos. 4,401,046 and 4,365,568. The sewing machine of the present invention forms a chain stitch by using an in-line looper system which is distinguishable from a machine using a transverse looper system such as, for example, the machines disclosed in U.S. Pat. Nos. 4,726,305 and 4,834,010. A sewing machine using a transverse looper system forms the chain stitch by cycling through an elliptical path that is perpendicular to the direction of sewing. Because of the perpendicular relationship and ample space below the needle plate, trimmer systems cutting below the needle plate have been used on machines using the transverse looper system. The problem with using such machines, however, is that they are limited to about 5 needles and a small sewing width.

Machines using the in-line looper system, however, can use more than 30 needles and provide an unlimited sewing width. As such, they are more desirable for certain commercial applications. In such machines, however, the loopers move only in a straight line parallel to the direction of sewing and, as such, require the use of an extra component, a set of coaxially aligned spreaders, one for each needle, to form the stitch by moving perpendicular to the direction of sewing. Because of the extra components, one spreader for each needle, there is little space for positioning an automatic thread trimmer system below the needle plate. Instead, thread trimmers typically have been positioned above the needle plate congesting the working space above the needle plate, such as, for example, the machine disclosed in U.S. Pat. No. 4,461,229.

U.S. Pat. No. 4,879,960 issued to Prais discloses an in-line thread trimmer system that automatically cuts the threads below the needle plate. However, this thread trimmer system is adaptable for use with a flat bed sewing machine only and cannot be used with a cylinder bed sewing machine because of the smaller circumference of the cylinder bed. Generally, the flat bed type sewing machine is used for sewing in the horizontal plane over the surface of the bed, which means there is no restriction on the bed circumference. The smaller circumference of the cylinder bed type sewing machine allows goods such as waistbands or cuffs to encircle the bed and be sewn. Consequently, size considerations are of paramount concern with the cylinder bed sewing machine, making the addition of a thread trimmer system extremely difficult. As a result, thread trimmers have typically been positioned above the needle plate for cylinder bed sewing machines, congesting the working space above the needle plate.

A prior art chain stitch sewing machine having an in-line looper system is indicated generally at 10 in FIG. 1. Machine 10 comprises a base 12, having a bed plate 14 supported atone end and a vertical standard 16 supported at the other end, and a horizontal arm 18 extending from vertical standard 16 over bed plate 14 to support a head 20. A needle bar 22 is slidably mounted within head 20 and carries a needle holder 24 in which ten needles 25 are secured. The needles 25 descend from a top to a bottom position through oblong openings in a foot 28 supported by head 20 and a needle plate 29 supported on bed plate 14.

Continuing with FIG. 1, the sewing direction into machine 10 is indicated by an arrow 30 and the sewing direction out of machine 10 is indicated by an arrow 31. A U-shaped slide assembly 32 is mounted on base 12 and opens against the sewing direction toward arrow 30. A knife support bracket 36 is slidably mounted within assembly 32 and carries ten arrow-shaped knives 38 which move coaxially with the sewing direction between a retracted position as shown and an extended position in which bracket 36 is moved against the closed end of slider assembly 32. An L-shaped actuator arm 40 is pivotally connected to bed plate 14 by a screw 42 and has one end pivotally connected to bracket 36. As can be seen in FIG. 1, the prior art machine 10 has a relatively large bed circumference.

Accordingly, there is a need for an in-line thread trimmer system for use with a cylinder bed sewing machine, which thread trimmer system automatically cuts the threads below the needle plate and, more specifically, one that cuts the last chain stitch being sewn in a first piece of material so that it does not unravel and then positions the tail end of the threads so that they are automatically set up for the first chain stitch in the next piece of material to be sewn.

SUMMARY OF THE INVENTION

The present invention meets these needs by providing an apparatus for severing the needle and looper threads of a chain stitch formed in a piece of material by a cylinder bed sewing machine that has an in-line looper system. The cylinder bed sewing machine also comprises a needle plate and a needle carrying the needle thread through the material and the needle plate to form a needle loop of needle thread therebelow which has a needle side running to the needle. The looper system comprises a looper carrying the looper thread through the needle loop and a spreader receiving the looper thread from the looper.

The apparatus comprises a stationary knife positioned below the needle plate that has an edge against which the needle and looper threads are severed and a spring positioned below the stationary knife and biased in a direction toward the stationary knife. The apparatus further comprises a movable knife slidably mounted between the stationary knife and the spring which yieldingly urges the movable knife thereagainst. The movable knife has one penetrating end with a pair of axially offset barbs, a lagging barb and a leading barb closer to the penetrating end of the movable knife than the lagging barb. The apparatus finally comprises actuating means, connected to the other end of the movable knife, for extending the penetrating end through the needle loop so that the leading barb hooks the needle side of the needle loop and the lagging barb hooks the looper thread and retracting the penetrating end far enough beyond the edge of the stationary knife to sever the needle and looper threads carried by the barbs.

The spring may be a leaf spring having one end biased against the movable knife to pinch the looper thread therebetween when the movable knife is retracted. This ensures that the looper thread is held in place after being severed. The leaf spring may also extend beyond the edge of the stationary knife to pinch the looper thread and hold it in place before being severed. The apparatus may further comprising pulling means, positioned adjacent the looper, for pulling enough slack in the looper thread so that the looper forms a feed loop in the looper thread being positioned within the needle loop when penetrated by the looper to form the first stitch in a next piece of material to be sewn. The pulling means comprises a U-shaped finger, having one end hooked around the looper thread, and looper actuating means, connected to the other end of the finger, for moving the finger to pull the required slack in the looper thread.

The present invention also meets these needs by providing a method for severing the needle and looper threads of a chain stitch formed in a piece of material by a sewing machine having an in-line looper system. The method comprising the steps of severing the needle side of the needle loop below the needle plate, severing the looper thread below the needle plate leaving a severed supply end from the looper, and holding the severed supply end in place for a next stitch to prevent it from slipping through the looper. The method further comprises the steps of pulling slack in the looper thread while the needle forms a next needle loop for the next stitch, forming a feed loop with the slack in the looper thread, and positioning the feed loop within the needle loop to form the next stitch.

Accordingly, it is an object of the present invention to provide a method and apparatus for severing the needle and looper threads of the last chain stitch formed in a piece of material by using an in-line looper system below the needle plate; to provide a method and apparatus that severs the threads so that they do not unravel; and to provide a method and apparatus that positions the tail ends of the threads after being severed so that they are automatically set up for the first stitch in the next piece of material to be sewn. Other objects and advantages of the invention will be apparent from the following description, the accompanying drawings, and the appended claims.

DETAILED DESCRIPTION OF THE PREFERRED EMBODIMENTS

Figure 1:
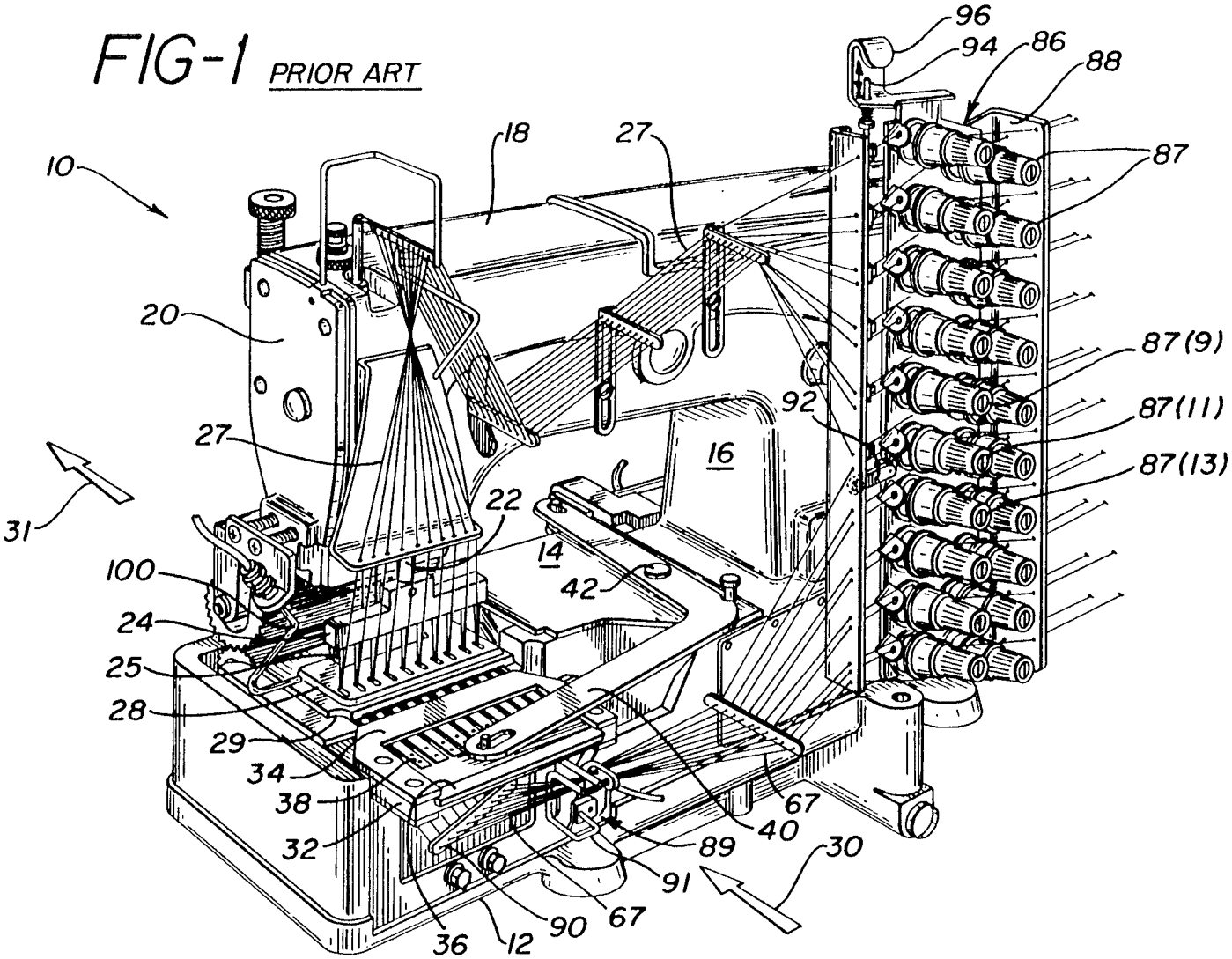
FIG-1 PRIOR ART
FIG. 1 is a perspective view of an in-line chain stitch sewing machine comprising a thread trimmer assembly, a needle thread pull assembly and a looper thread pull assembly in accordance with the present invention.
Figure 2:
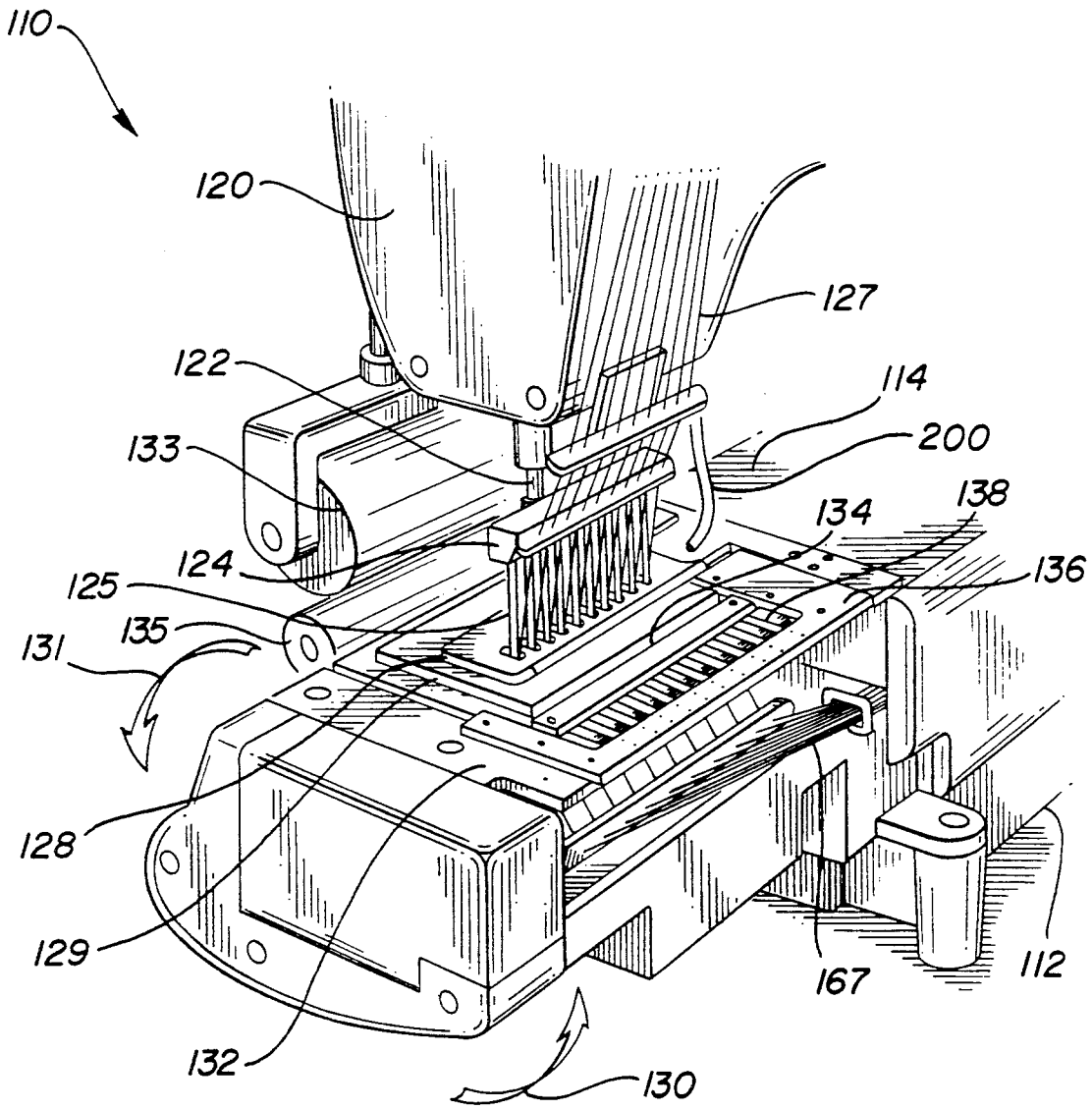
FIG. 2 is a partial perspective view of a cylinder bed version of the sewing machine of FIG. 1.
Figure 3:
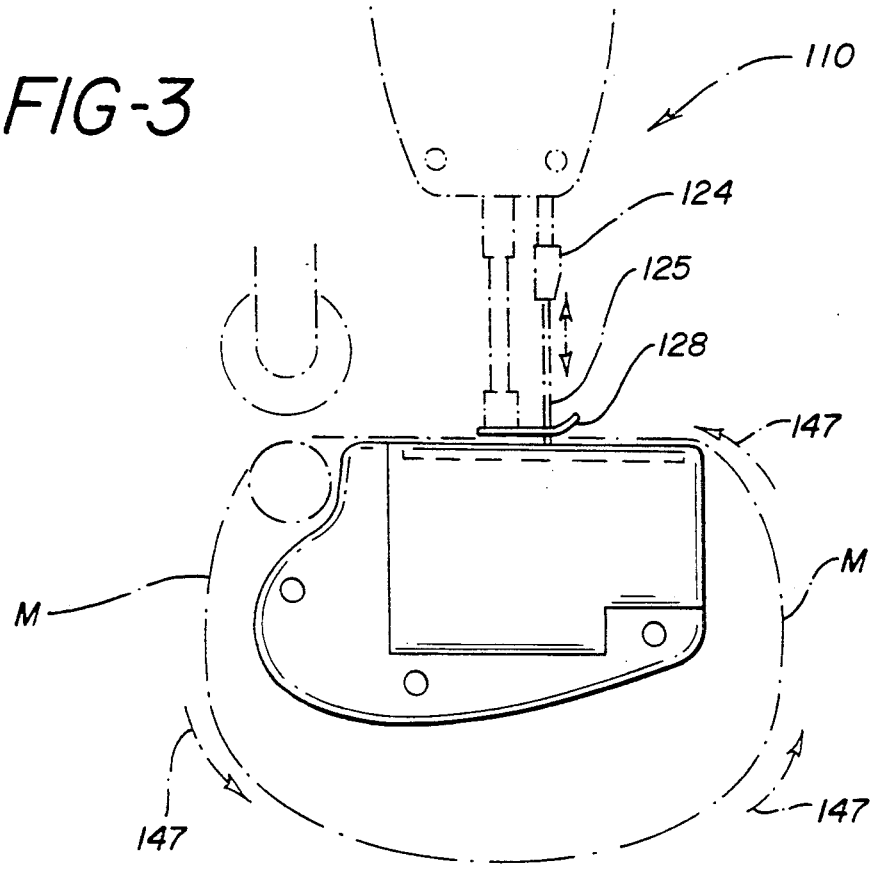
FIG. 3 is a schematic end view of the cylinder bed sewing machine of FIG. 2.
Figure 4:
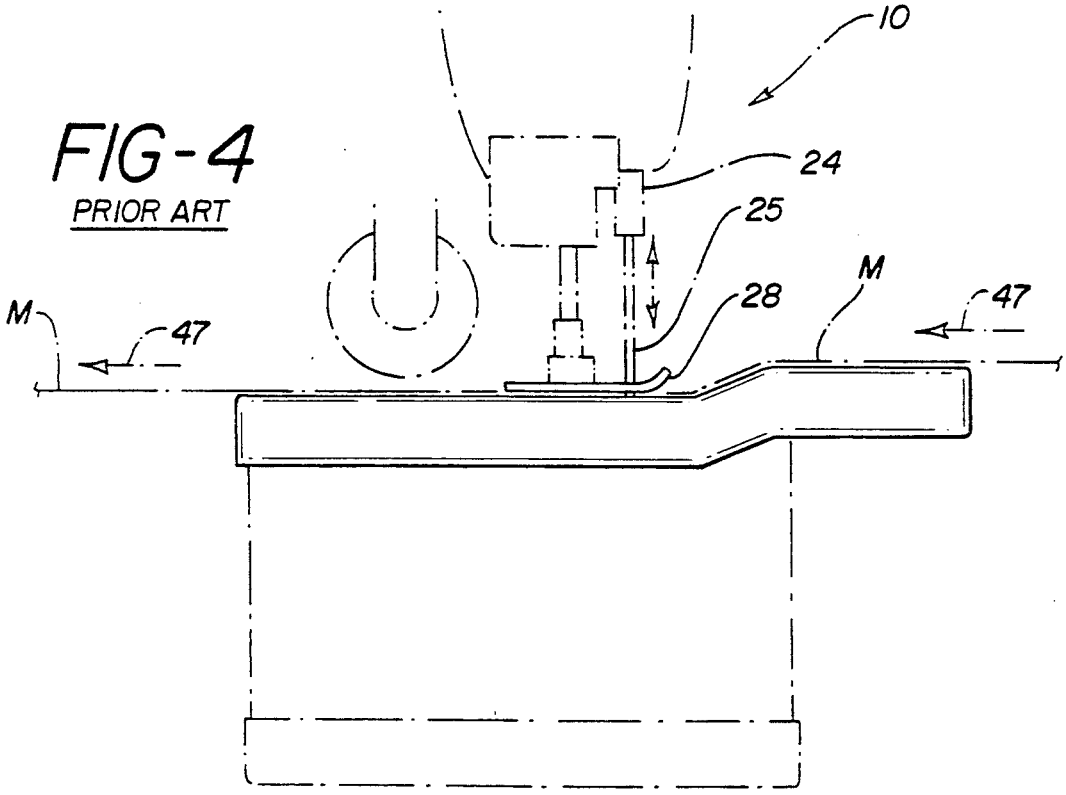
FIG-4 PRIOR ART
FIG. 4 is a schematic end view of the flat bed sewing machine of FIG. 1, illustrating the difference between the flat bed sewing machine of FIG. 1 and the cylinder bed sewing machine of FIG. 2.

In FIG. 2 a chain stitch cylinder bed sewing machine having an in-line looper system indicated generally as 110 in FIG. 2 is illustrated in accordance with the present invention. The flat bed sewing machine of FIG. 1 has a much larger bed circumference than the cylinder bed sewing machine. So although a thread trimmer system or cutting apparatus typically adds to the bed circumference, this is not a problem with the flat bed sewing machine, as it is used for sewing in the horizontal plane over the surface of the bed, as illustrated by the sewing direction indicated by arrows 47 of a material M in FIG. 4. The cylinder bed configuration poses significant restraints on the use of such a thread trimmer system or cutting apparatus, however, because it is the smaller circumference of the cylinder bed that allows goods to be sewn around the bed, such as cuffs or waistbands, as illustrated by the circular sewing direction indicated by arrows 147 of material M in FIG. 3. Consequently, the unique design of a slide assembly 132 of FIGS. 5–10 of the present invention allows the cutting mechanism, slide assembly 132, to be added to the cylinder bed machine 110 without increasing the bed circumference of the machine 110.

Figure 10:
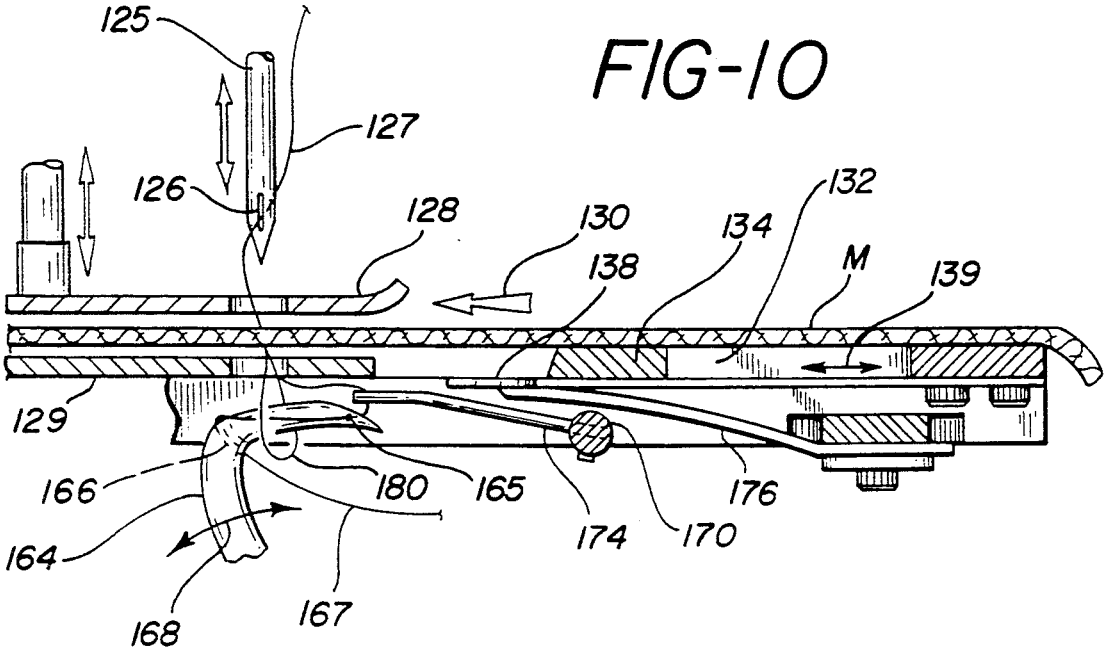
FIG. 10 is a schematic cross-sectional view to show the relationship between the cylinder bed machine of FIG. 2 and the cutting mechanism of FIG. 5.
Figure 11:
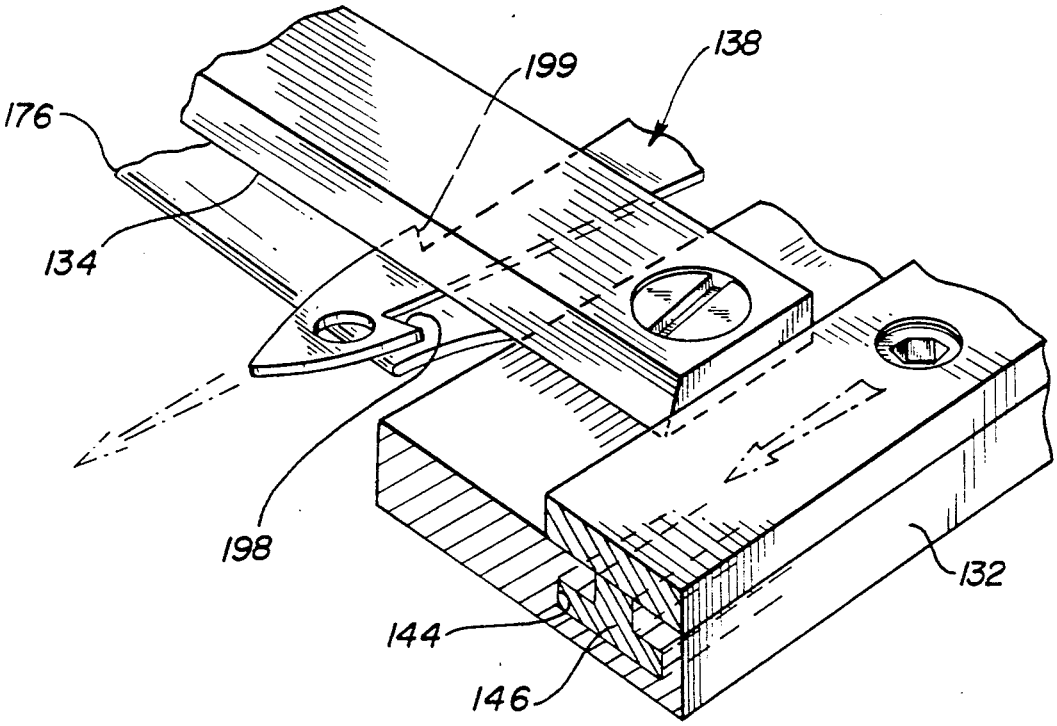
FIG. 11 is a partial perspective view of a portion of the cylinder bed sewing machine of FIG. 2.

Referring in more detail to FIG. 2, machine 110 comprises a base 112, having a cylinder bed plate 114 having a vertical standard (not shown) at one end for supporting a horizontal arm (not shown) extending from the vertical standard over the cylinder bed plate 114 to support a head 120. A needle bar 122 is slidably mounted within head 120 and carries a needle holder 124 in which a plurality of needles 125 are secured. The needles 125 descend from a top to a bottom position through oblong openings in a foot 128 supported by head 120 and a needle plate 129 supported on bed plate 114. Each needle 125 has an eye 126 which carries a needle thread 127, as illustrated in FIG. 10.

The sewing direction into machine 110 is indicated by an arrow 130 and the sewing direction out of machine 110 is indicated by an arrow 131. Rollers 133 and 135 are used for pressure to feed a material M, illustrated in FIG. 3, through the machine 110. A U-shaped bracket 136 is mounted on base 112 and opens against the sewing direction toward arrow 130. A stationary blade 134 is mounted on the closed end of slide assembly 132 and has a cutting edge facing the edge of needle plate 129. A knife support bracket 136 is slidably mounted within slide assembly 132 and carries a plurality of arrow-shaped knives 138 which move coaxially with the sewing direction between a retracted position as shown and an extended position in which bracket 136 is moved against the closed end of slide assembly 132 as indicated by a bidirectional arrow 139 in FIG. 5.

Figure 5:
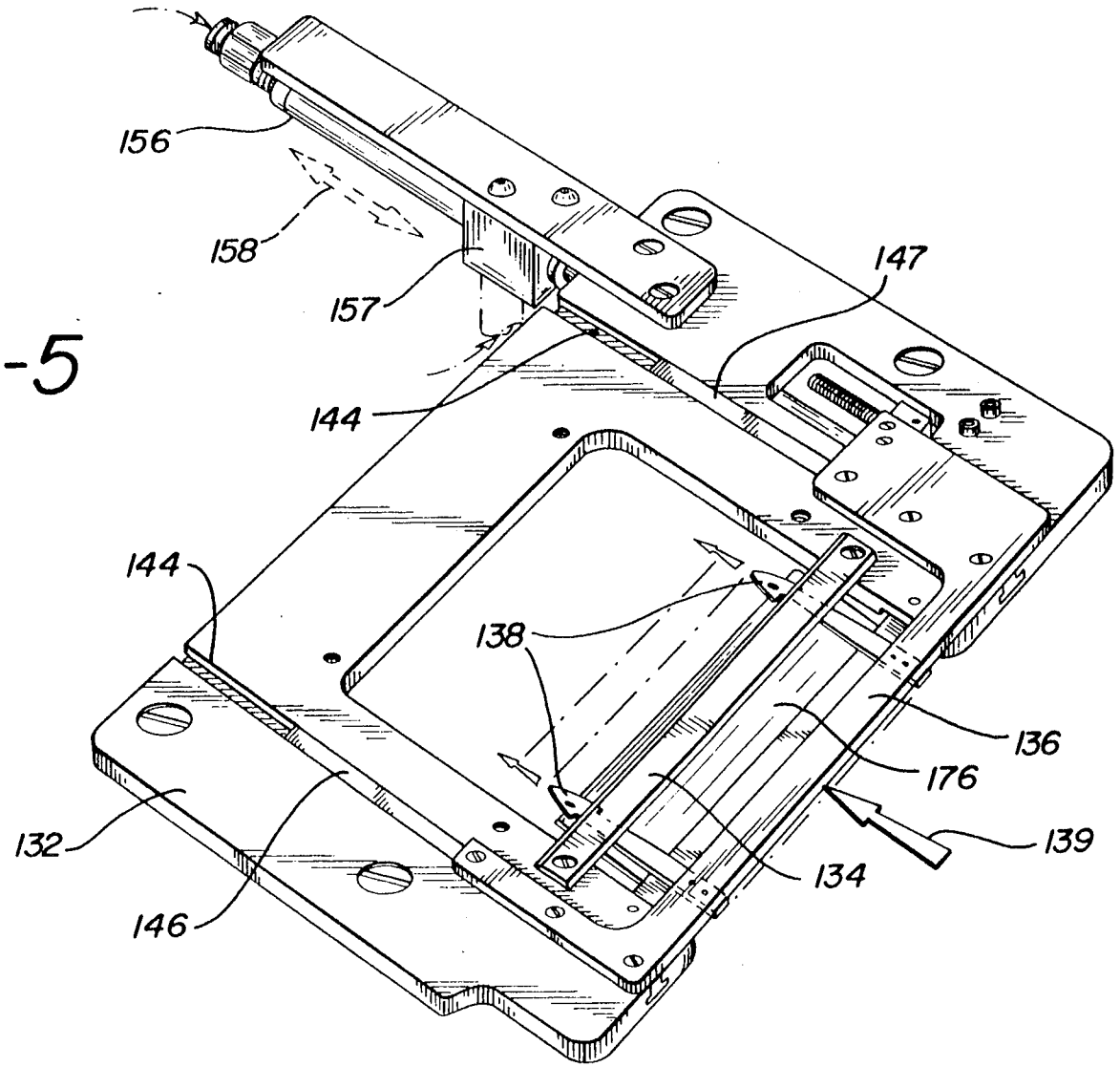
FIG. 5 is a perspective view of the self-contained cutting mechanism of the present invention.
Figure 6:
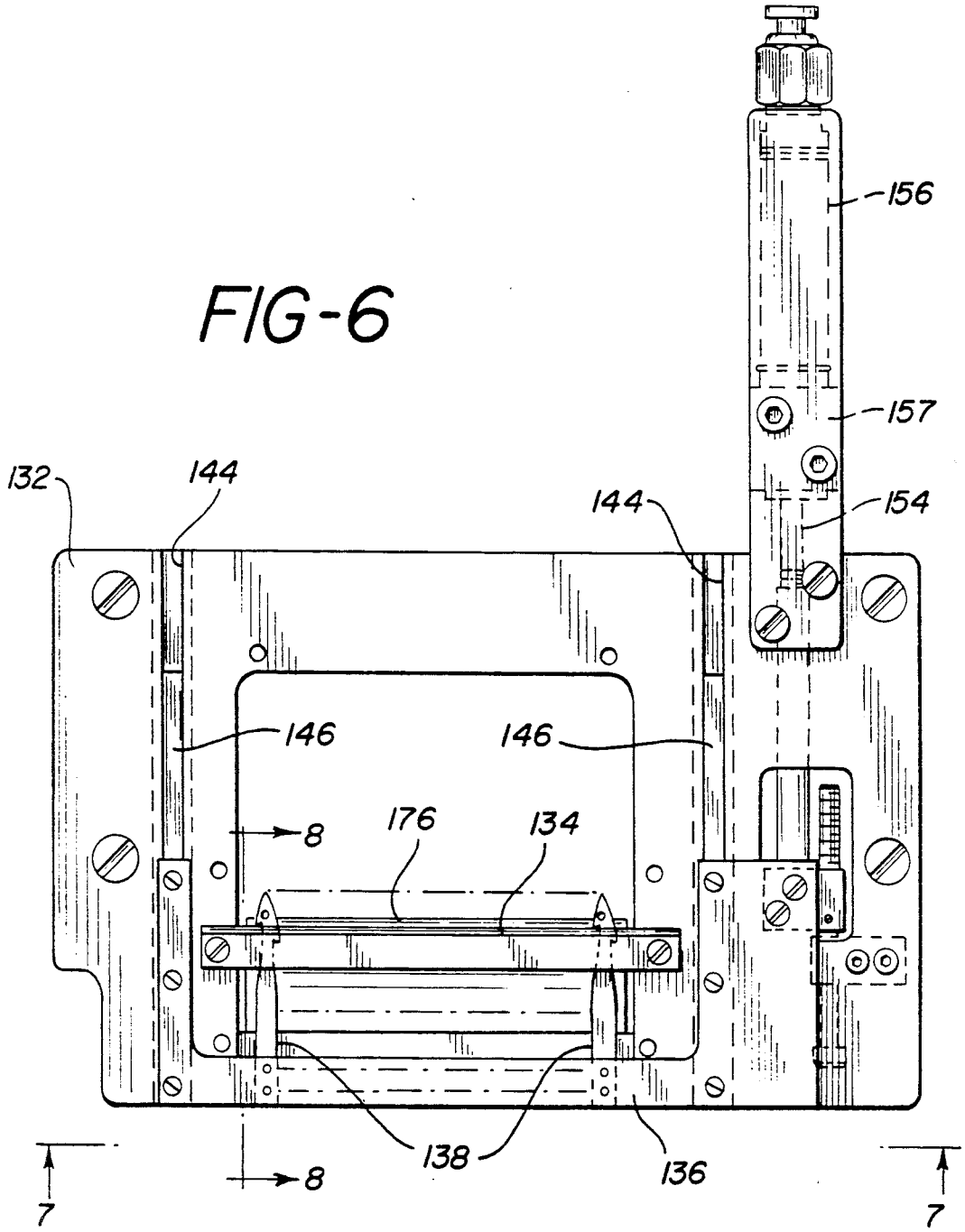
FIG. 6 is a top plan view of the cutting mechanism of FIG. 5.
Figure 9:
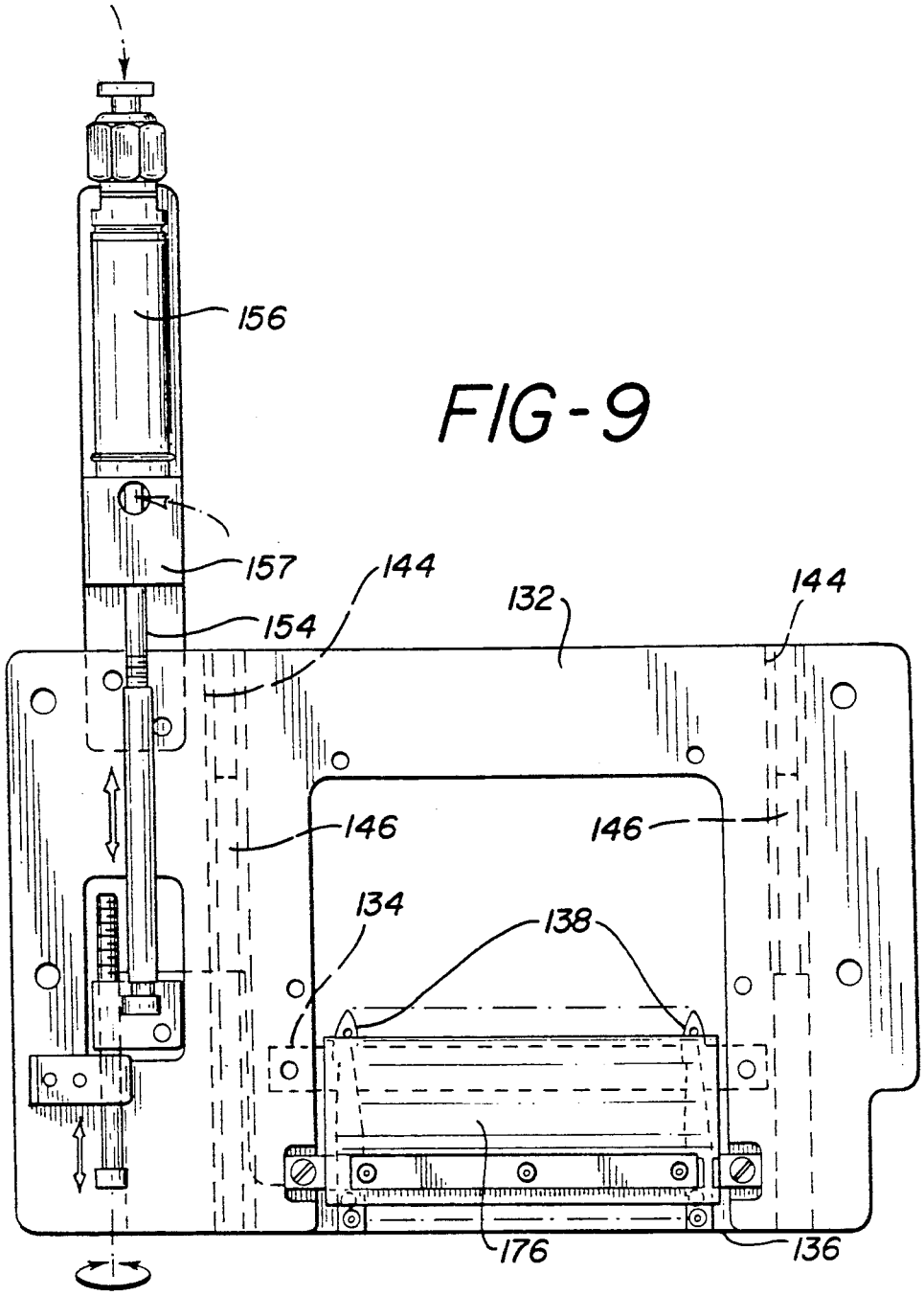
FIG. 9 is a bottom plan view of the cutting mechanism of FIG. 5.

Referring in more detail to FIGS. 5, 6, and 9, a perspective view, a top plan view, and a bottom plan view, respectively, of the slide assembly 132 of the present invention is illustrated. A U-shaped bracket 136 is bolted to an extending element 146 imbedded in slot 144 to permit the U-shaped bracket 136 to move as the extending member 146 slides up and down within the confines of slot 144. A piston rod 154, best illustrated in FIG. 9, of a single-action compressed air cylinder 156 is mounted on the slide assembly 132 by bracket 157. Air cylinder 156 moves in a direction transverse to the sewing direction as indicated by a bidirectional arrow 158 to move knives 138 between the retracted and extended positions. As the cylinder 156 moves back and forth, the U-shaped bracket 136 is caused to move back and forth, which, in turn, causes the knives 138 to move back and forth.

Figure 7:
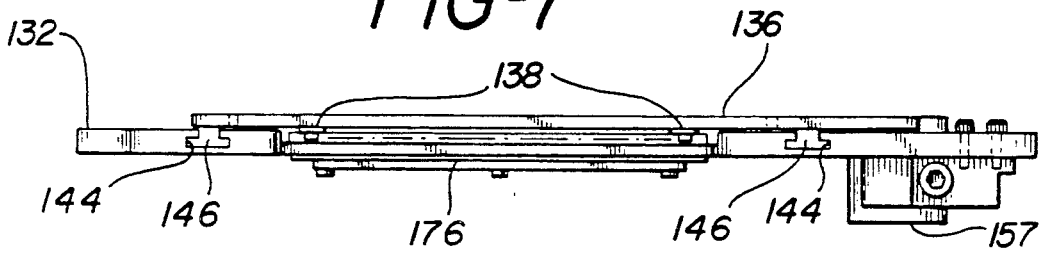
FIG. 7 is a front edge view of the cutting mechanism of FIG. 5.
Figure 8:
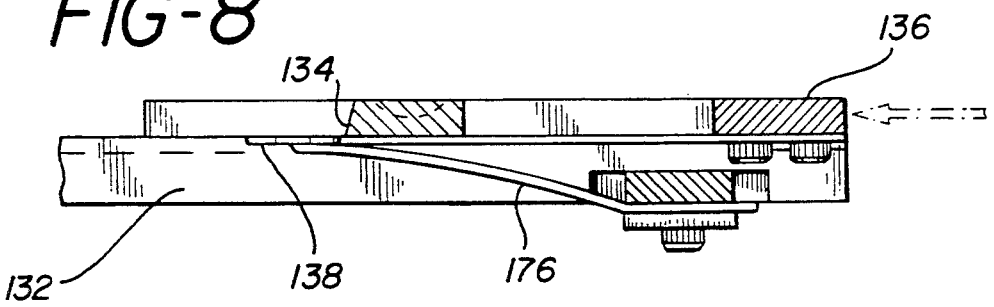
FIG. 8 is an enlarged cross-sectional view of the cutting mechanism of FIG. 5.

Referring now to FIGS. 7 and 8, a front edge view along line 7—7 of FIG. 5, and an enlarged cross-sectional view along line 8—8 of FIG. 5, respectively, of the cutting mechanism of FIG. 5 are illustrated. Each knife 138 slides between stationary blade 134 and a leaf spring 176 which is supported by the front portion of U-shaped slide assembly 132. Leaf spring 176 presses knife 138 against the underside of stationary blade 134 and cooperates with knife 138 to cut the threads during a trimming mode which will be described below in more detail. Knives 138 have been designed to grab the threads and drag them back to be cut by stationary blade 134 in cooperation with leaf springs 176 in a small trimming space defined as being below needle plate 129 and above spreaders 174.

Referring now to FIG. 10, a schematic cross-sectional view is illustrated to show the relationship between the cylinder bed machine of FIG. 2 and the cutting mechanism of FIG. 5. A plurality of loopers 164 are journaled within base 112 under needle plate 129, each one cooperating with a corresponding needle 125 to form a type 401 stitch, i.e., a double chainstitch. Each looper 164 has an eye 165 and a guide eyelet 166 which carry a looper thread 167. Looper 164 moves in a direction coaxially with the sewing direction as indicated by a bidirectional arrow 168. A spreader support shaft 170 is actuated by a mechanism 172 to move in a direction transverse to the sewing direction as indicated by an arrow 173 and carries a plurality of spreaders 174, each one cooperating with a corresponding looper 164 to form the type 401 stitch in the conventional fashion.

Continuing with FIG. 10, each knife 138 slides between stationary blade 134 and a leaf spring 176 which is supported by the front portion of U-shaped slide assembly 132. Leaf spring 176 presses knife 138 against the underside of stationary blade 134 and cooperates with knife 138 to cut the threads during a trimming mode which will be described below in more detail. It should be noted, however, that knives 138 have been designed to grab the threads and drag them back to be cut by stationary blade 134 in cooperation with leaf springs 176 in a small trimming space defined as being below needle plate 129 and above spreaders 174. Unlike any in-line looper machine in the prior art that trims the threads in the congested work space above the needle plate, the present invention provides a machine that cuts the threads below the needle plate to reduce congestion in the work space.

Figure 20:
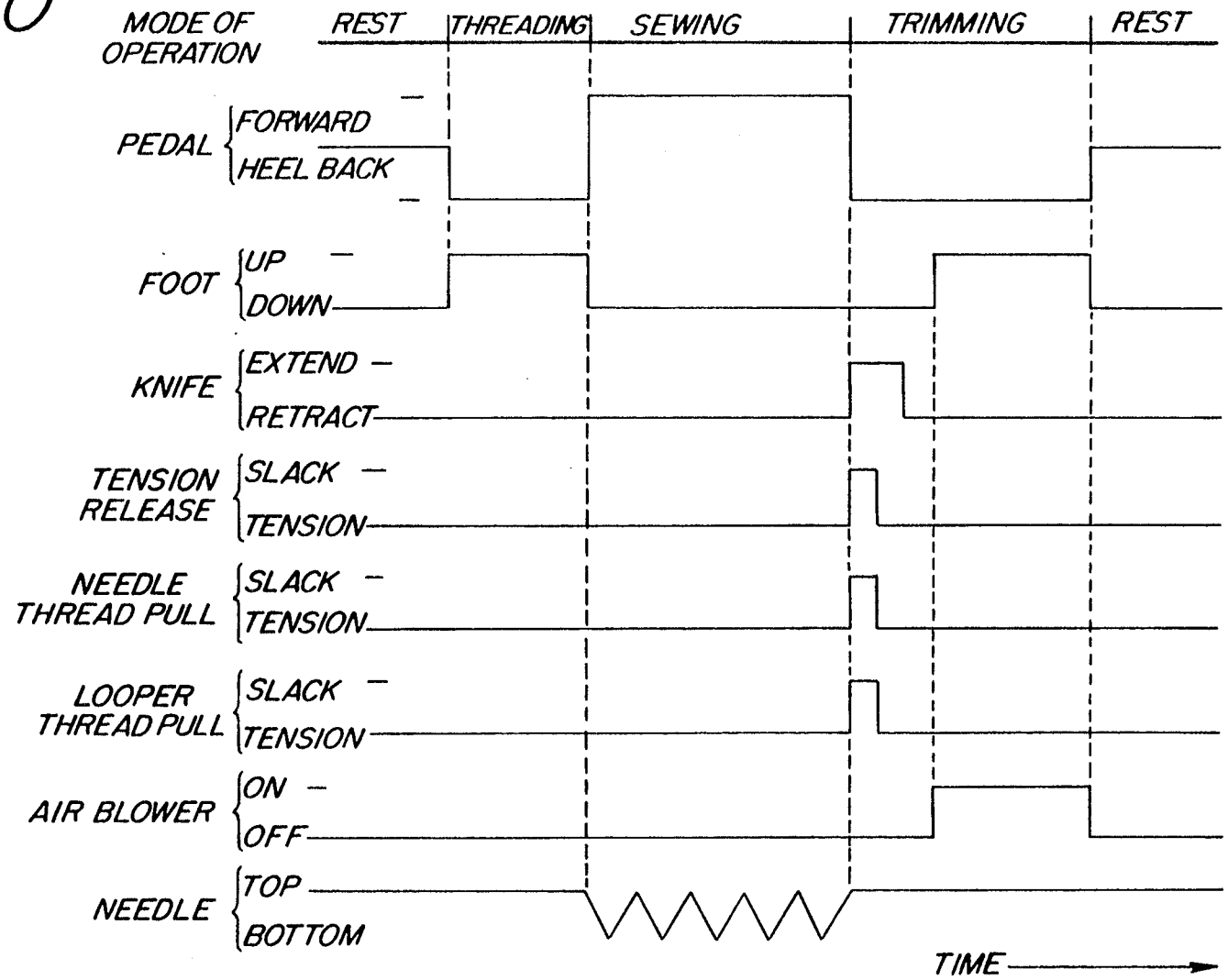
FIG. 20 is a timing chart showing the sequence of operation for various components of the sewing machine of FIG. 1 and the cylinder bed sewing machine of FIG. 2.

In operation, machine 110 operates in three modes: the threading mode, the sewing mode and the trimming mode just referred to above. The threading and sewing modes used to form double chain stitches is well known in the art, but will be described briefly to the extent necessary for a clear understanding of the invention. Referring also to FIG. 20, needle 125 is always in the top position when machine 110 is at rest. When the machine pedal (not shown) is heeled back while machine 110 is in the rest position, the electronic control unit (not shown) of machine 110 generates a first foot-control signal which actuates a solenoid (not shown) that raises foot 128. A first piece of material M is inserted in the direction indicated by arrow 130 between foot 128 and needle plate 129 while needle 125 remains in the top position as shown. When the sewing machine pedal is pressed forward, foot 128 drops and presses against the material M and needle 125 descends to commence sewing in the sewing mode.

The needle 125 descends from the top position and pierces the material M carrying thread 127 therethrough, while looper 164 moves back out of the path of the descending needle 125. When needle 125 reverses direction and returns to the top position, a needle thread loop **127*a* is formed below needle plate 129 and has a needle side 127*n* and a material side 127*m*. The needle side 127*n* is the supply of needle thread 127 from needle 125 and the material side 127*m* is the demand side connected to the previous stitch in the material M. As needle 125 retracts, looper 164 penetrates needle loop 127*a* carrying looper thread 167 therethrough to form a loop 167*a* which is grabbed by a notch in spreader 174. Spreader 174 moves away from the sewing path and pulls loop 167*a* in the same direction. Needle 125 reaches the top position and descends again to form another stitch in the material M. Sewing is stopped when the sewing machine pedal is again heeled back. When the pedal is heeled back while machine 110** is sewing, the trimming mode commences automatically and will be discussed below in more detail.

Figure 12:
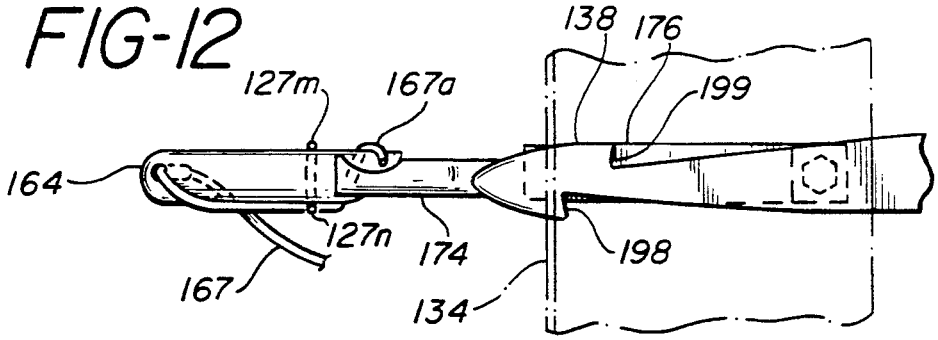
FIGS. 12–15 are partially schematic, top plan views of a single knife and looper of the cutting mechanism of FIG. 2, where the knife is shown at different positions, taken along the line 12—12 of FIG. 10.
Figure 13:
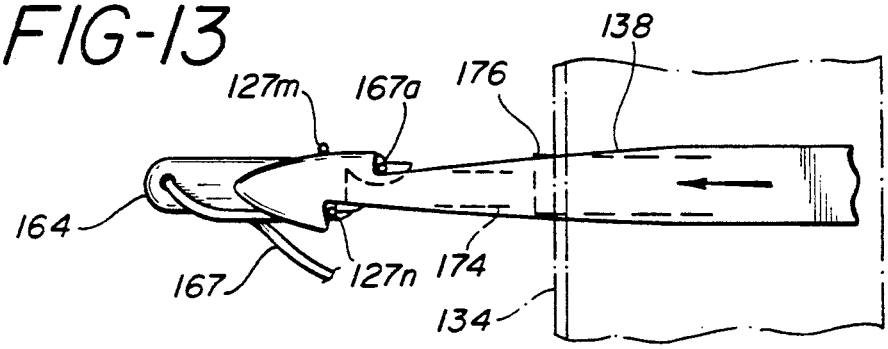
Figure 14:
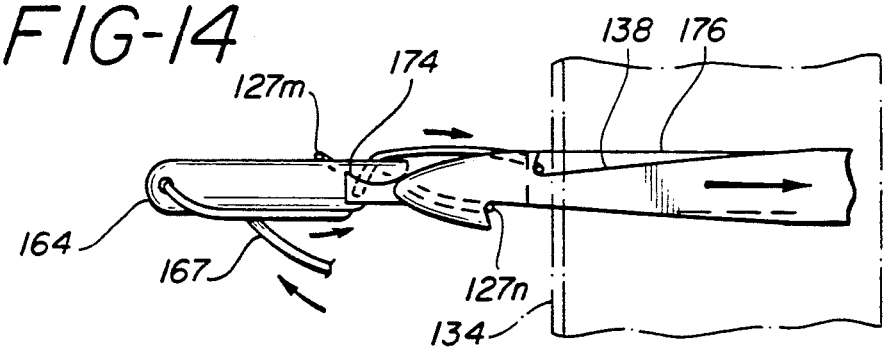

As mentioned above, the trimming mode commences automatically when the sewing machine pedal is heeled back while machine 110 is in the sewing mode. At this point needle 125 automatically returns to the top position so that the first piece of material M can be removed and another inserted to be sewn. The electronic control of machine 110 generates a cut signal to a solenoid A (not shown) which provides compressed air to air cylinder 156 and initiates four events as follows. First, thread tension in the needle and looper threads is reduced. Second, the extra needle thread 127 is pulled so that enough thread is available for knives 138 when they are retracted as shown in FIGS. 14 and 17. While this is being done, extra looper thread 167 is pulled so that enough thread is available for knives 138 when they are retracted as shown in FIGS. 14 and 17. After slack is provided to both needle threads 127 and looper threads 167, tension is again applied thereto. Third, knives 138 are moved from the retracted position shown in FIG. 12 to the extended position shown in FIGS. 13 and 16. The end of each knife 138 extending toward needle loop **127*n* is shaped like the tip of an arrow having a pair of axially offset barbs, a leading barb 198 closer to the tip and a lagging barb 199. The barbs are offset so that leading barb 198 grabs needle side 127*n*** of needle loop 127*a* and lagging barb 199 grabs looper thread 167 when knives 138 reach the extended position, while leaving material side 127*m* of needle loop 127*a* intact.

Figure 15:
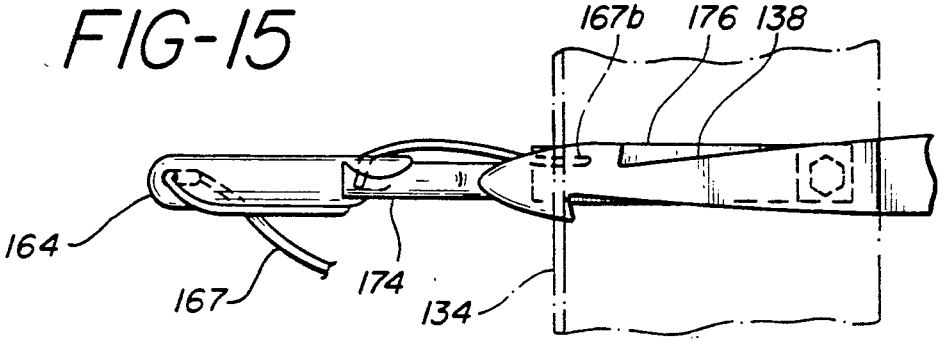
Figure 17:
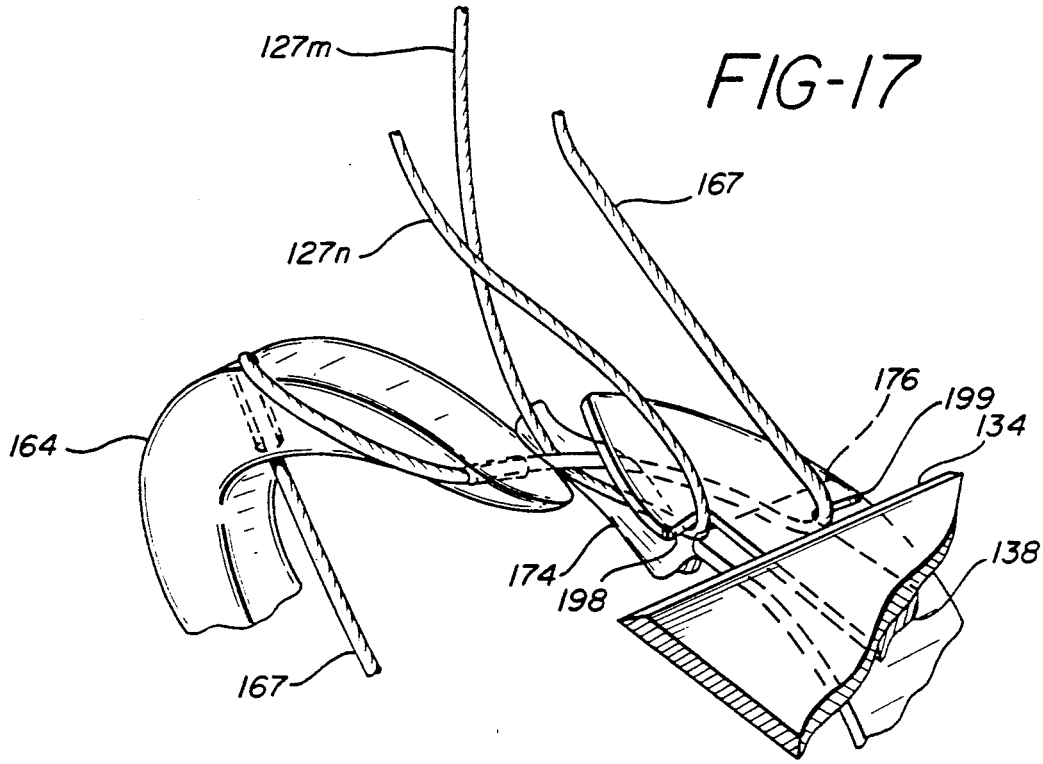
Figure 18:
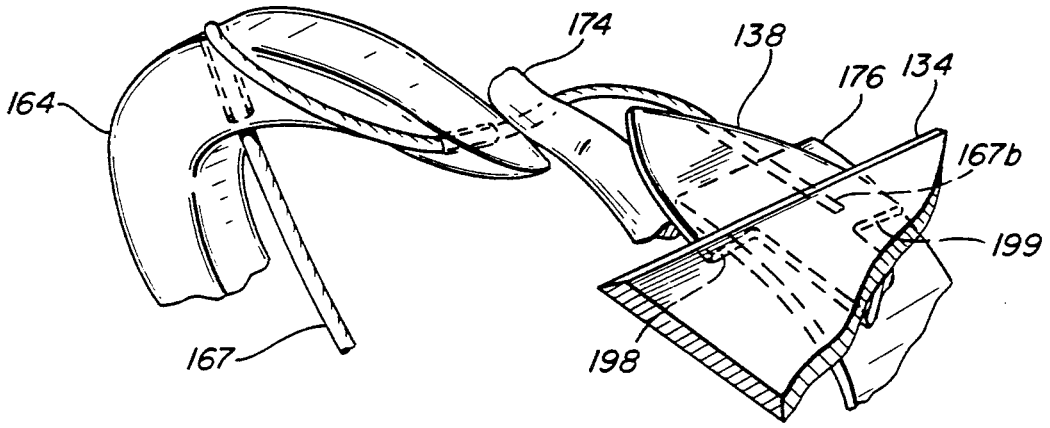

When the air to cylinder 156 is shut off, knives 138 retract as shown in FIGS. 14 and 17. The barbs 198 and 199 pull the extra slack in the needle and looper threads 127 and 167 through needle 125 and looper 164, respectively, toward the cutting edge of stationary knife 134. As knives 138 continue to retract, looper thread 167 is severed between lagging barb 199 and stationary knife 134 so that the severed supply end 167*b* of looper thread 167 is pinched between knife 138 and spring 176 as shown in FIGS. 15 and 18. Thus, the supply end of looper thread 167 does not slip back through looper 164 and is held in place for the first stitch in the next piece of material to be inserted. When knives 138 are fully retracted as shown in FIGS. 15 and 18, the needle side 127*n* of needle loop 127*a* is severed between leading barb 198 and stationary knife 138 so that the material side 127*m* is longer than the severed needle side 127*n* of needle thread 127. The extra length in the material side 127*m* of needle thread 127 is necessary to better ensure that the knot formed in the last stitch in material M is locked so that it will not come undone.

As mentioned above, the trimming mode commences automatically when the sewing machine pedal is heeled back while machine 110 is in the sewing mode. At this point needle 125 automatically returns to the top position so that the first piece of material M can be removed when foot 128 is raised and another piece of material can be inserted. The electronic control of machine 110 provides a time-delayed second foot-control signal to solenoids B and C (not shown) which lifts foot 128 and actuates an air blower (not shown) via air blower tube 200 (FIG. 2). The signal is delayed until after knives 138 have been retracted. When material M is removed, the material side 127*m* of needle thread 127 and the tail end of looper thread 167 are removed with material M and the needle side 127*n* of the needle thread 127 is blown above needle plate 129 by the air blower to be in position for the first stitch in the next piece of material inserted into machine 110. This leaves only the severed supply end 167*b* below needle plate 129 as shown in FIG. 18. After material M is removed, the pedal is returned to the rest position from being heeled back which lowers foot 128 and turns off the air blower.

Unlike prior chain stitch, in-line machines, machine 110 of the present invention cuts the thread for the last stitch below needle plate 129 to keep the work area above the plate uncluttered. Furthermore, machine 110 cuts the thread automatically without the intervention of an operator. Additionally, knives 138 and 134 cut only one side of the needle thread loop 127*a* so that the tail end of the needle thread 127*n* better locks the last stitch in material M. Another feature of the present invention is that the needle and looper threads 127 and 167 are automatically set up for the first stitch in the next piece of material to be sewn.

Figure 16:
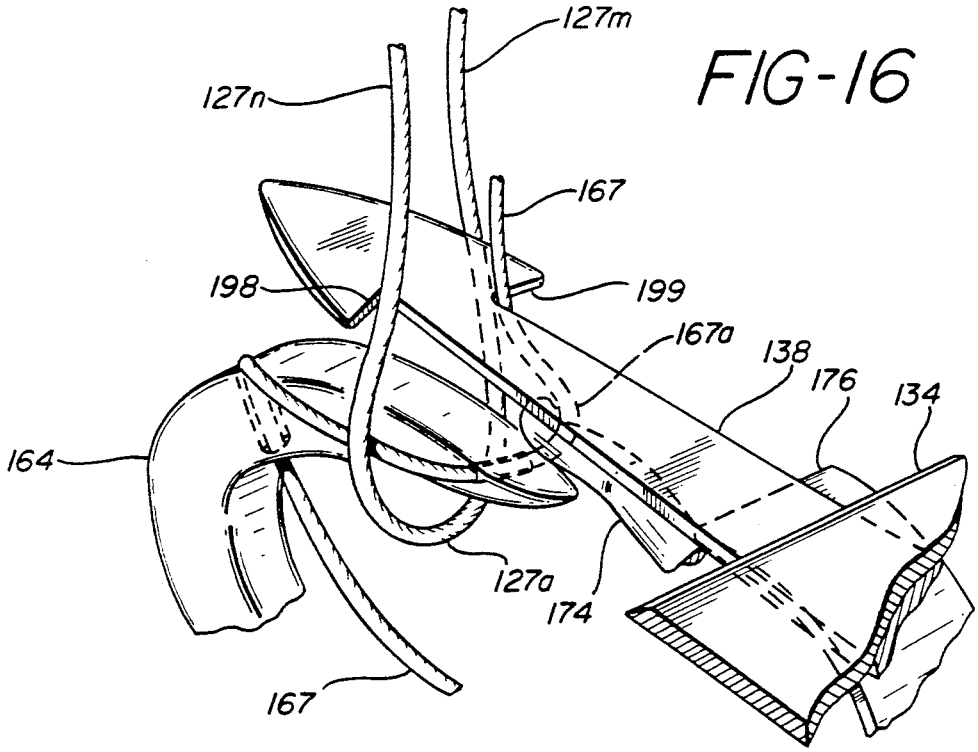
FIGS. 16–19 are partially schematic, perspective views of the single knife and looper of the cutting mechanism of FIG. 2, wherein FIGS. 16–18 correspond to FIGS. 13–15, respectively.
Figure 19:
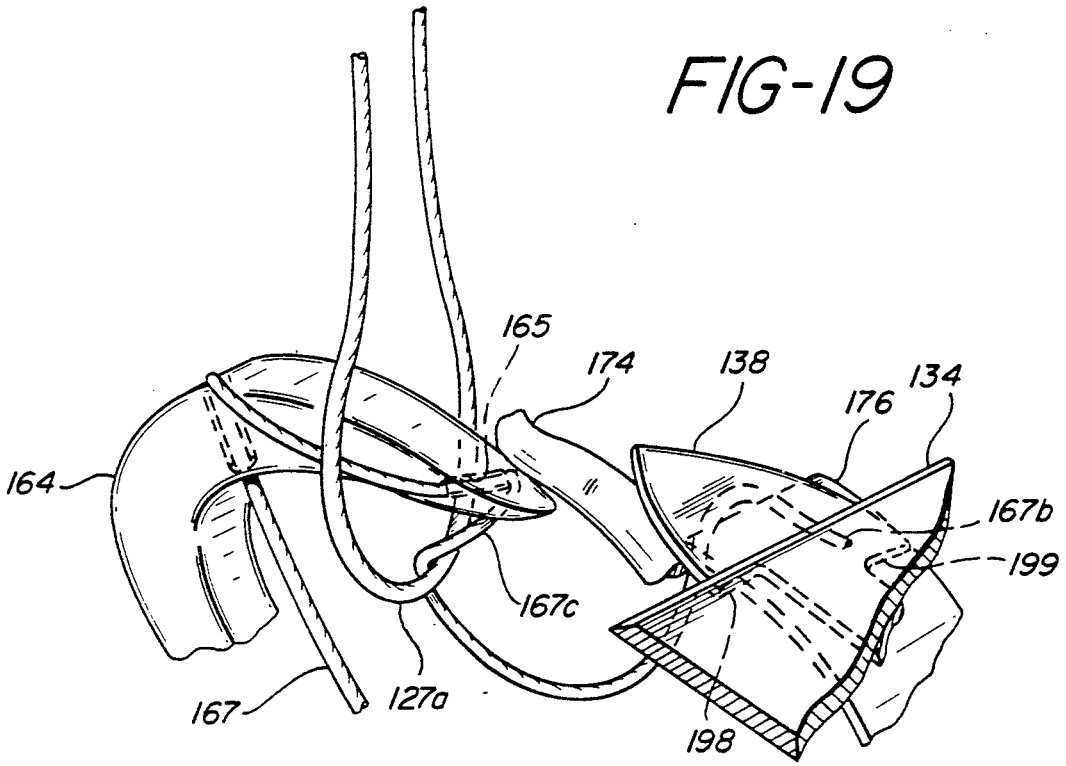

When needle 125 forms the first needle loop 127*a*, the normal loop 167*a* in looper thread 167 cannot be formed as shown in FIG. 16 because the severed supply end 167*b* is being held in place by knife 138 of the present invention as shown in FIG. 19. However, enough extra slack is pulled in looper thread 167 so that looper 164 can pull the slack when it rocks back and form a feed loop 167*c* when it penetrates needle loop 127*a* as shown in FIG. 19. As referred to above, the number of thread-guiding surfaces that create friction must be minimized so that the slack does form between looper eye 165 and knife 138. After the first stitch is formed, the material moves in the direction indicated by arrows 130 and 131 and pulls the severed supply end 167*b* with it so that subsequent stitches will be formed as shown in FIG. 16 and as described above.

Having described the invention in detail and by reference to preferred embodiments thereof, it will be apparent that other modifications and variations are possible without departing from the scope of the invention defined in the appended claims.

What is claimed is:

1. Apparatus for severing the needle and looper threads of a chain stitch formed in a piece of material by a cylinder bed sewing machine having a bed circumference and a needle plate, a needle carrying the needle thread through the material and the needle plate to form a needle loop of needle thread therebelow having a needle side running to the needle, a looper carrying the looper thread through the needle loop, and a spreader receiving the looper thread from the looper, said apparatus comprising:

a stationary knife positioned below the needle plate and having an edge against which the needle and looper threads are severed;

a spring positioned below said stationary knife and biased in a direction toward said stationary knife;

a movable knife slidably mounted between said stationary knife and said spring yieldingly urging said movable knife thereagainst and having one penetrating end with a pair of axially offset barbs, a lagging barb and a leading barb closer to said penetrating end of said movable knife than said lagging barb;

a slide assembly to which the needle plate and said movable knife are mounted so as to maintain the bed circumference of the cylinder bed sewing machine; and actuating means, connected to the other end of said movable knife, for extending said penetrating end through the needle loop so that said leading barb hooks the needle side of the needle loop and said lagging barb hooks the looper thread and retracting said penetrating end far enough beyond said edge of said stationary knife to sever the needle and looper threads carried by said barbs.

2. Apparatus as recited in claim 1, wherein said spring is a leaf spring having one end biased against said movable knife to pinch the looper thread therebetween when said movable knife is retracted, whereby the looper thread is held in place after being severed.

3. Apparatus as recited in claim 2, wherein said leaf spring extends beyond said edge of said stationary knife to pinch the looper thread and hold it in place before being severed.

4. Apparatus as recited in claim 2, further comprising pulling means, positioned adjacent said looper, for pulling enough slack in the looper thread so that the looper forms a feed loop in the looper thread being positioned within the needle loop when penetrated by the looper to form the first stitch in the next piece of material to be sewn.

5. Apparatus as recited in claim 4, wherein said pulling means comprises a U-shaped finger, having one end hooked around the looper thread, and looper actuating means, connected to the other end of said finger, for moving said finger to pull the required slack in the looper thread.

6. A method for severing the needle and looper threads of a chain stitch formed in a piece of material by a cylinder bed sewing machine having a bed circumference and a needle plate, a needle carrying the needle thread through the material and the needle plate to form a needle loop of needle thread therebelow having a needle side running to the needle, a looper carrying the looper thread through the needle loop, and a spreader receiving the looper thread from the looper, said method comprising the steps of:

positioning a slide assembly below the needle plate so as to maintain the bed circumference of the cylinder bed sewing machine;

positioning a stationary knife below the needle plate so that the edge thereof is oriented to sever the needle and looper threads;

positioning a spring below the stationary knife so that it is biased in a direction toward the stationary knife; slidably mounting a movable knife on the slide assembly and between the stationary knife and the spring which yieldingly urges the movable knife thereagainst;

extending the movable knife through the needle loop so that a leading barb of the knife hooks the needle side of the needle loop and a lagging barb of the knife hooks the looper thread; and retracting a penetrating end of the knife far enough beyond the edge of the stationary knife to sever the needle and looper threads carried by the barbs.

7. A method as recited in claim 6, further comprising the steps of pulling slack in the looper thread, using the slack to form a feed loop in the looper thread, and positioning the feed loop within the needle loop to form the first stitch in the next piece of material to be sewn.

* * * * *